US008708870B2

(12) United States Patent
Nalley

(10) Patent No.: US 8,708,870 B2
(45) Date of Patent: Apr. 29, 2014

(54) WEIGHT PLATE WITH CENTER POST LOCKING CARTRIDGE

(76) Inventor: Mark Nalley, Murrieta, CA (US)

( * ) Notice: Subject to any disclaimer, the term of this patent is extended or adjusted under 35 U.S.C. 154(b) by 450 days.

(21) Appl. No.: 13/068,063

(22) Filed: May 3, 2011

(65) Prior Publication Data

US 2012/0283071 A1 Nov. 8, 2012

(51) Int. Cl.
*A63B 21/062* (2006.01)
*A63B 21/06* (2006.01)

(52) U.S. Cl.
USPC ..... 482/98; 482/99

(58) Field of Classification Search
USPC ..... 482/93–108, 133–137
See application file for complete search history.

(56) References Cited

U.S. PATENT DOCUMENTS 1,052,962 A * 2/1913 Reach ..... 482/102
1,053,109 A * 2/1913 Reach ..... 482/99
1,752,412 A * 4/1930 Blickman ..... 482/90
D519,173 S * 4/2006 Nalley ..... D21/680
7,473,211 B2 * 1/2009 Lee ..... 482/97
7,608,021 B1 * 10/2009 Nalley ..... 482/98
8,075,458 B2 * 12/2011 Nalley ..... 482/98
8,152,702 B2 * 4/2012 Pacheco ..... 482/103
2009/0048079 A1 * 2/2009 Nalley ..... 482/107

* cited by examiner

*Primary Examiner* — Stephen Crow
(74) *Attorney, Agent, or Firm* — Morland C. Fischer

(57) ABSTRACT

A weight plate for use with physical fitness weightlifting equipment so that the weight plate may be coupled to other weight plates and lifted together in a stack. Each weight plate includes a pivotal switch arm including a first end at which to receive a pushing force to cause the switch arm to rotate relative to the weight plate and an opposite end at which a curved fork is carried. In one embodiment, a center post runs continuously through the center bore holes of the weight plates. In another embodiment, an insert is located in the center bore hole of each weight plate to be mated to the insert from an adjacent plate. When the pivotal switch arm of any weight plate is rotated to a locked position, the curved fork is rotated with the switch arm into surrounding engagement with the center post or the insert.

20 Claims, 11 Drawing Sheets

WEIGHT PLATE WITH CENTER POST LOCKING CARTRIDGE

BACKGROUND OF THE INVENTION

1. Field of the Invention

This invention relates to a weight plate adapted to be selectively coupled to the center post of physical fitness weight-lifting equipment so that one or more weight plates may be lifted by the center post during a body-building exercise. The weight plate includes a locking cartridge having a curved fork that is carried by a rotatable toggle lever switch arm and moved between locked and unlocked positions within a channel through the weight plate body so that the weight plate can be either coupled to or decoupled from the center post.

2. Background Art

My U.S. Pat. No. 7,608,021 issued Oct. 27, 2009 discloses a weight plate that is associated with weight lifting equipment by which the weight plate or a stack of weight plates can be lifted during a body building exercise. This weight plate includes a plate body and a locking cartridge connected to the plate body. The displacement of a locking pin through the weight plate body is controlled by a manually-accessible toggle lever arm that is located within the locking cartridge and coupled to the locking pin. When the toggle lever arm is rotated to an on or locked position, the locking pin is correspondingly caused to slide in a first direction through the plate body to engage a connection union mounted in an adjacent weight plate. When the toggle lever arm is rotated to an off or unlocked position, the locking pin is caused to slide in an opposite direction through the plate body to be disengaged from the connection union.

It would be desirable to take advantage of my previously-patented weight plate and the locking cartridge thereof so that the weight plate can be selectively and releasably attached to a conventional center post or to a modified connecting union (i.e., insert) that is associated with weightlifting equipment so that the weight plate can be lifted with a stack of similarly-attached weight plates during a body building exercise. In particular, it would be desirable to achieve the aforementioned benefit, but without including the use of a separate locking pin that slides through the locking cartridge to engage with or disengage from a connecting union as a toggle lever arm is rotated.

SUMMARY OF THE INVENTION

In general terms, a weight plate is disclosed that is useful in certain physical fitness weight lifting equipment in which one or a stack of weight plates is lifted during a body building exercise. The weight plate includes a plate body having at least a central bore hole formed therethrough. The central bore hole through the plate body is sized to receive either a known center post from the weight lifting equipment or a coupling insert. A locking cartridge is connected to the weight plate body.

The locking cartridge has a housing that is received within a cavity formed in the weight plate body. A manually-operated toggle lever switch arm is connected to a pivot and adapted to rotate within the housing between locked and unlocked positions. One end of the toggle lever switch arm is connected to a switch control knob outside the housing to which a rotational force is applied by a user to cause a corresponding rotation of the switch arm inside the housing to one of the locked or unlocked positions. A curved fork or catch having a pair of fingers that are spaced from one another is connected to the opposite end of the toggle lever switch arm.

The fork is moved along an intermediate channel that extends through the weight plate body between the housing of the locking cartridge and center bore hole of the weight plate.

According to a first preferred embodiment of this invention, when the switch control knob is rotated in a first direction, the toggle lever switch arm is correspondingly rotated to the locked position. In this case, the fork carried by the switch arm is moved through the intermediate channel of the weight plate body and into locking engagement with the center post of the weightlifting equipment at the center bore hole, whereby the weight plate is coupled to and lifted by the center post along with a stack of similarly coupled weight plates. When the switch control knob is rotated in an opposite direction, the toggle lever switch arm is correspondingly rotated to the unlocked position. In this case, the fork carried by the switch arm is moved through the intermediate channel and out of its former locking engagement with the center post, whereby the weight plate is uncoupled from the center post and removed from the stack.

In accordance with a second preferred embodiment of this invention, the aforementioned center post is replaced by a series of coupling inserts, each of which being mated to a weight plate at the center bore hole thereof and each of which being adapted to be detachably connected to another insert that is mated to another weight plate. The insert includes a plug at one end and a locking receptacle formed by a pair of spaced, parallel-aligned locking rings at the opposite end. The insert is mated to a first weight plate such that the locking receptacle is located in the center bore hole and the plug projects outwardly from the weight plate body. The outwardly-projecting plug of the insert from the first weight plate is wedged into engagement with the locking receptacle of the insert at the center bore hole of the second weight plate. Accordingly, the inserts are connected in a series one to the other, and the first and second weight plates are interconnected face-to-face one another. The weight plates can be lifted in a stack once the toggle lever switch arms of the respective locking cartridges thereof are rotated to the locked position as previously disclosed, so that the forks carried by the switch arms are moved into locking engagement with the plugs of the inserts.

DESCRIPTION OF THE PREFERRED EMBODIMENT

Figure 1:
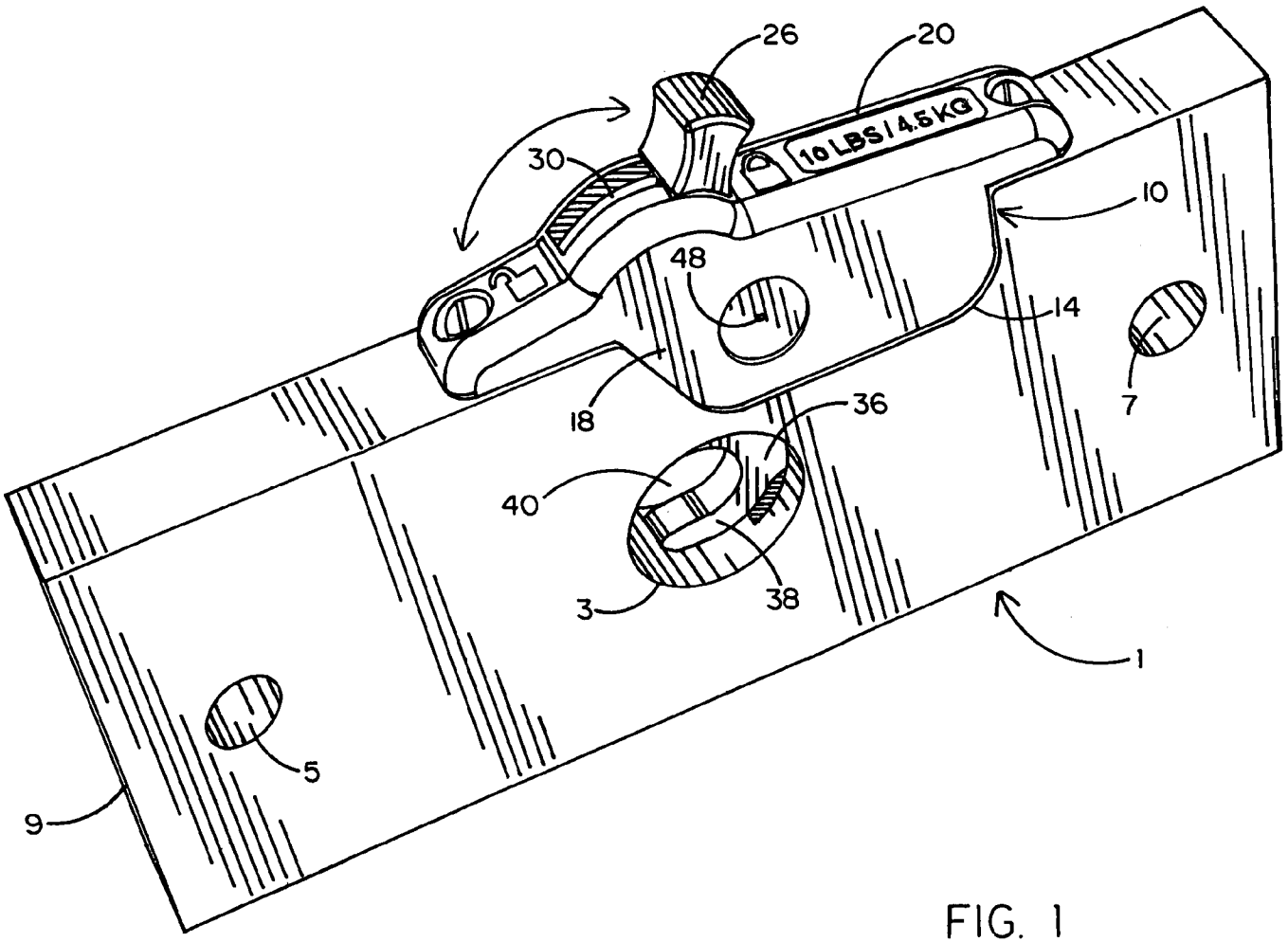
FIG. 1 is a perspective view of a weight plate having a locking cartridge with a rotatable toggle lever switch arm by which a fork is moved through the weight plate between locked and unlocked positions with respect to a center bore hole formed in the weight plate.
Figure 2:
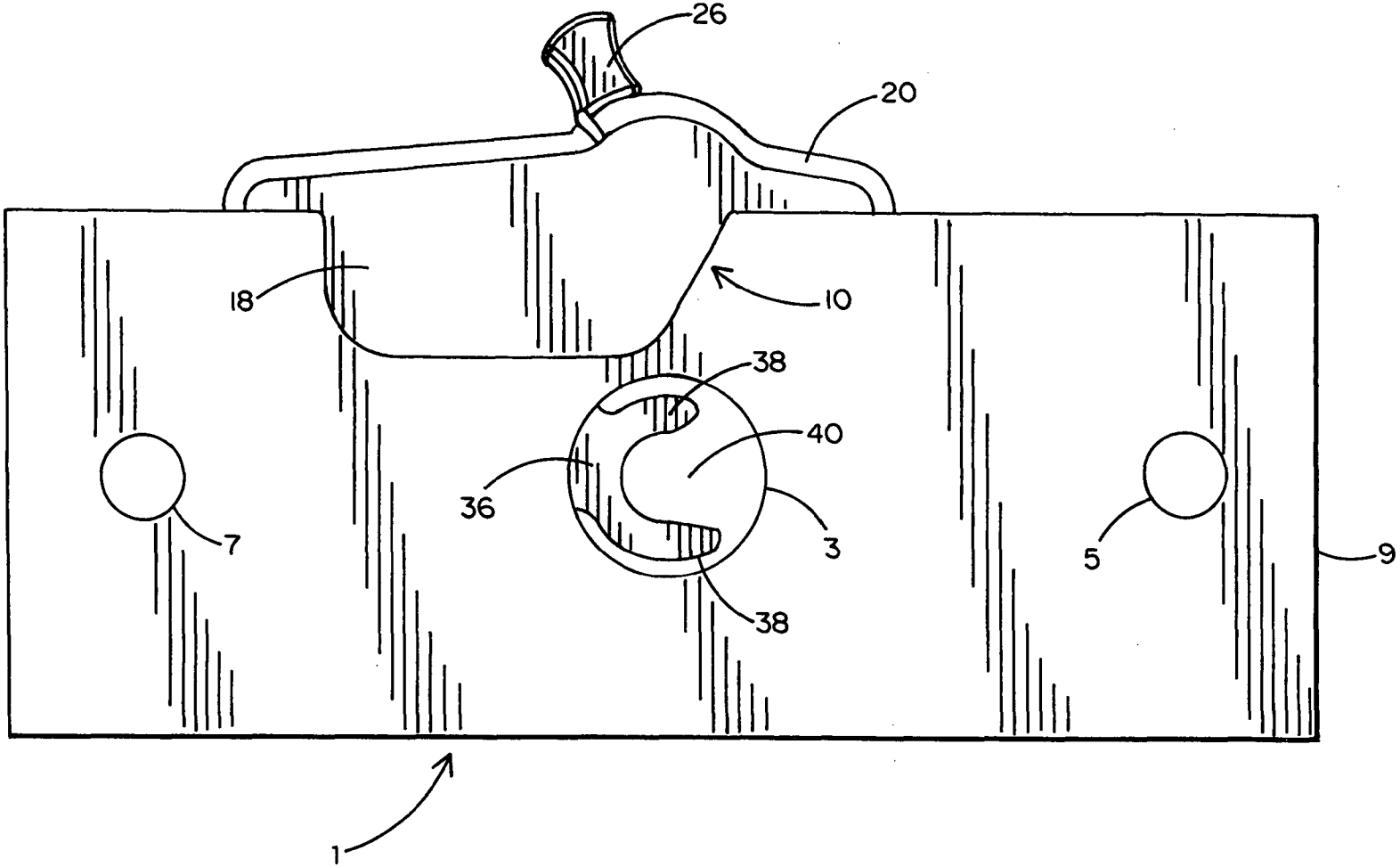
FIG. 2 is a top view of the weight plate of FIG. 1 with the fork thereof moved to the locked position.

Referring concurrently to FIGS. 1-4 of the drawings, there is shown a rectangular weight plate 1. The weight plate 1 has a center bore hole 3 and a pair of side bore holes 5 and 7. Each of the center and side bore holes 3, 5 and 7 extends vertically and completely through the weight plate 1. The center bore hole 3 is sized to accommodate a cylindrical center post (designated 50 and best shown in FIG. 5) from a weight plate lifting exercise apparatus. In the case where the weight plate 1 is one of a vertical stack of plates located one above the other, the center post 50 extends continuously and axially through the center bore hole formed in each of the weight plates in the stack. The side bore holes 5 and 7 are located at opposite sides of the center bore hole 3 and sized to accommodate respective cylindrical guide rods (not shown) that are common to many weight plate lifting apparatus. As will be understood, the guide rods provide vertical tracks along which one or more of the weight plates (e.g., 1) from the stack will ride during a weight lifting exercise. Thus, the aforesaid guide rods stabilize and prevent a rotation of a stack of weight plates during the weight lifting exercise.

By way of example, the weight plate 1 has a rectangular body 9 that may be manufactured from iron, steel, urethane, rubber, plastic or composite material. The weight plate body 9 is ideally ten inches long, four inches wide and one inch thick. The weight plate 1 can be manufactured in different (e.g., five and ten pound) weights and configurations. Therefore, the aforementioned materials and dimensions of the weight plate may change and should not be regarded as limitations of this invention.

Detachably connected to one side of the weight plate body 9 is a locking cartridge 10. Suitable fasteners 12 extend through the locking cartridge 10 whereby the cartridge is connected to the weight plate 1. Locking cartridge 10 is preferably manufactured from ABS plastic or a similar impact-resistant material. By removing the fasteners 12, the locking cartridge can be detached from the weight plate body 9 and repaired or replaced as necessary. However, it is to be understood that the locking cartridge 10 may otherwise be an integral non-detachable part of the weight plate 1 or be manufactured as a single co-extensive part including the weight plate body 9.

A cavity 14 is formed in the side of the weight plate body 9 to which the locking cartridge 10 is connected. The locking cartridge 10 includes a generally hollow housing 18 that is received inwardly of the cavity 14 formed in the weight plate body 9. As an important feature of this invention, a hollow (i.e., evacuated) intermediate channel 16 is created within the weight plate body 9 so as to lie between and communicate with the interior of the hollow housing 18 of cartridge 10 and the center bore hole 3 through weight plate 1. An elongated top 20 of the locking cartridge 10 extends across the housing 18 thereof. The top 20 of the locking cartridge 10 lies flush against the outside of the weight plate body 9. The fasteners 12 which connect the locking cartridge 10 to the weight plate 1 run through holes located at opposite ends of the top 20 of cartridge 10 for removable receipt by corresponding holes formed in the weight plate body 9.

The locking cartridge 10 includes a toggle lever switch arm 24 that is located within and rotatable through the hollow housing 18 of cartridge 10. The rotation of the toggle lever switch arm 24 within the housing 18 is controlled by a switch control knob 26. The switch control knob 26 is accessible outside the housing and above the top 20 of cartridge 10. The control knob 26 is connected to a first end 28 of the switch arm 24. The first end 28 projects outside the housing 18 through a guide slot 30 that is formed through the top 20 of the locking cartridge 10. The switch control knob 26 is moved back and forth in one of the directions indicated by the reference arrows of FIG. 1 so as to impart a corresponding movement (i.e., rotation) to the switch arm 24 within the housing 18 of cartridge 10.

The first end 28 of the toggle lever switch arm 24 is co-extensively connected to an opposite end 32 at an elbow 34. The first and opposite ends 28 and 32 of switch arm 24 are aligned with one another at an angle of about 135 degrees with respect to elbow 34. As another important feature of this invention, the opposite end 32 of switch arm 24 carries a curved catch or fork 36. The fork 36 carried by the switch arm 24 has a pair of projections or fingers 38 that lie opposite one another and are separated by a space 40. The fingers 38 of fork 36 bend towards each other such that the space 40 therebetween has a generally round configuration to accommodate the cylindrical center post of the weight lifting apparatus therewithin for a purpose that will soon be described.

A pivot hole 44 (best shown in FIG. 3) is formed through the elbow 34 of the toggle lever switch arm 24 at the intersection of the first and opposite ends 28 and 32 thereof. A pivot pin 46 (best shown in FIG. 4) projects inwardly from one wall of the housing 18 of the locking cartridge 10 to establish a pivot axis around which the switch arm 24 can rotate. The pivot pin 46 is received through the pivot hole 44, whereby the switch arm 24 is pivotally coupled to the pin 46 and adapted to rotate within the housing 18 of locking cartridge 10.

In particular, a rotational force applied by a user to the switch control knob 26 causes a corresponding rotation of the toggle lever switch arm 24 at the pivot pin 46. The switch control knob 26 and the toggle lever switch arm 24 to which the knob 26 is connected are rotatable between an unlocked position shown in FIG. 3 and a locked position shown in FIG. 4. As the control knob 26 is rotated, the first end 28 of the switch arm 24 is rotated through the guide slot 30 at the top 20 of the locking cartridge 10. At the same time, the fork 36 carried by the opposite end 32 of the switch arm 24 is rotated within the housing 18 of the locking cartridge 10. The fork 36 travels back and forth through the intermediate channel 16 of the weight plate body 9 in one of the directions indicated by the reference arrows of FIG. 3 depending upon whether the switch control knob 26 is being rotated to the unlocked or to the locked position.

Figure 4:
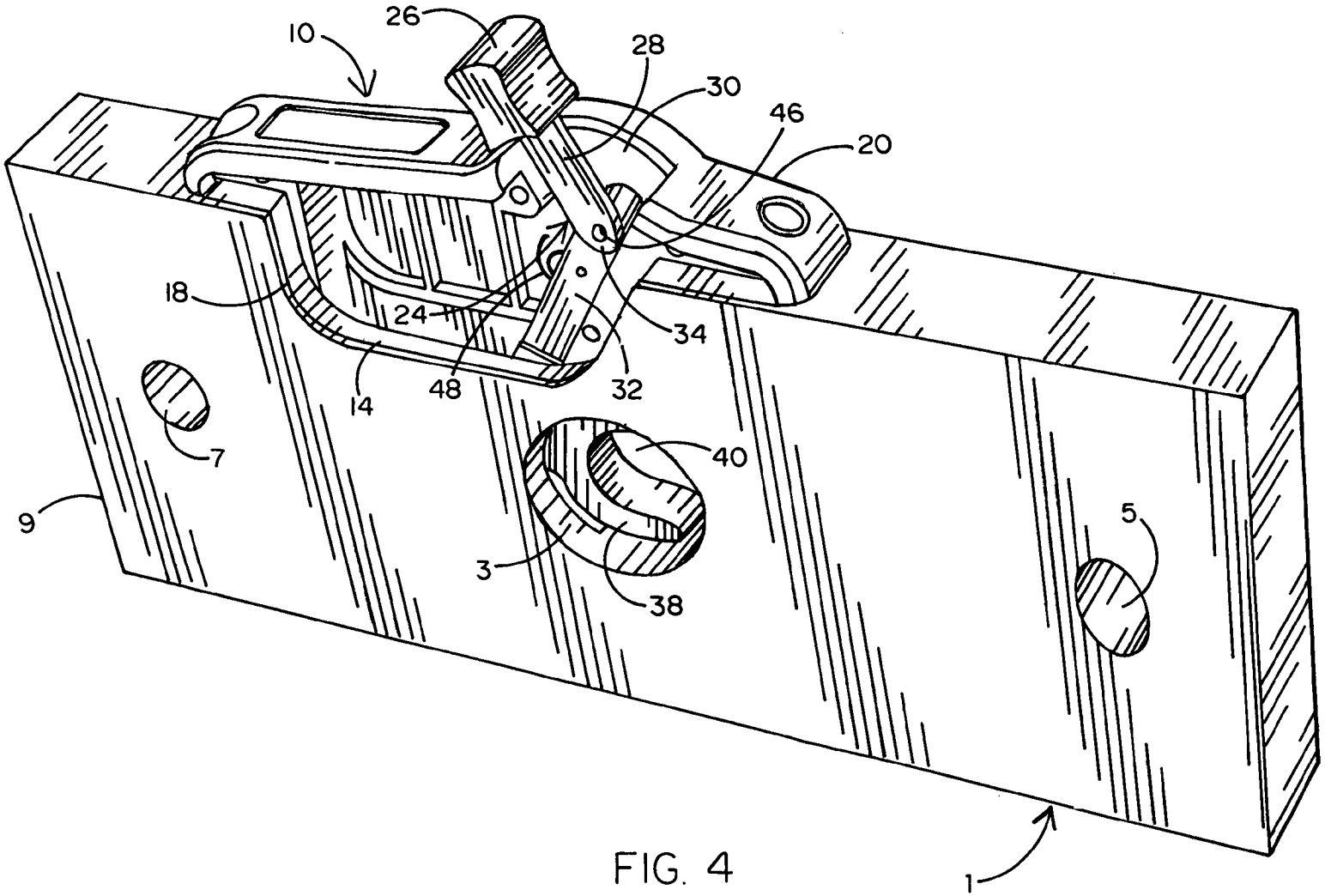
FIG. 4 is a perspective, partially broken-away view of the weight plate with the fork moved to the locked position.

In the case where the switch control knob 26 is rotated to the locked position of FIG. 4, the curved fork 36 is rotated at pivot pin 46 in a first direction through the intermediate channel 16 until the pair of spaced fingers 38 are moved inside and around the center bore hole 3 through the weight plate 1. As will be described in greater detail when referring to FIG. 5, when the switch control knob 26 is rotated to the locked position, the fork 36 is moved into locking engagement with the cylindrical center post (designated 50 in FIG. 5) of the weight lifting apparatus. That is, the center post will be captured within the round space 40 between the fingers 38 of the fork 36 so that the weight plate 1 is added to a stack of weight plates coupled to the center post to increase the total weight to be lifted during an exercise.

Figure 3:
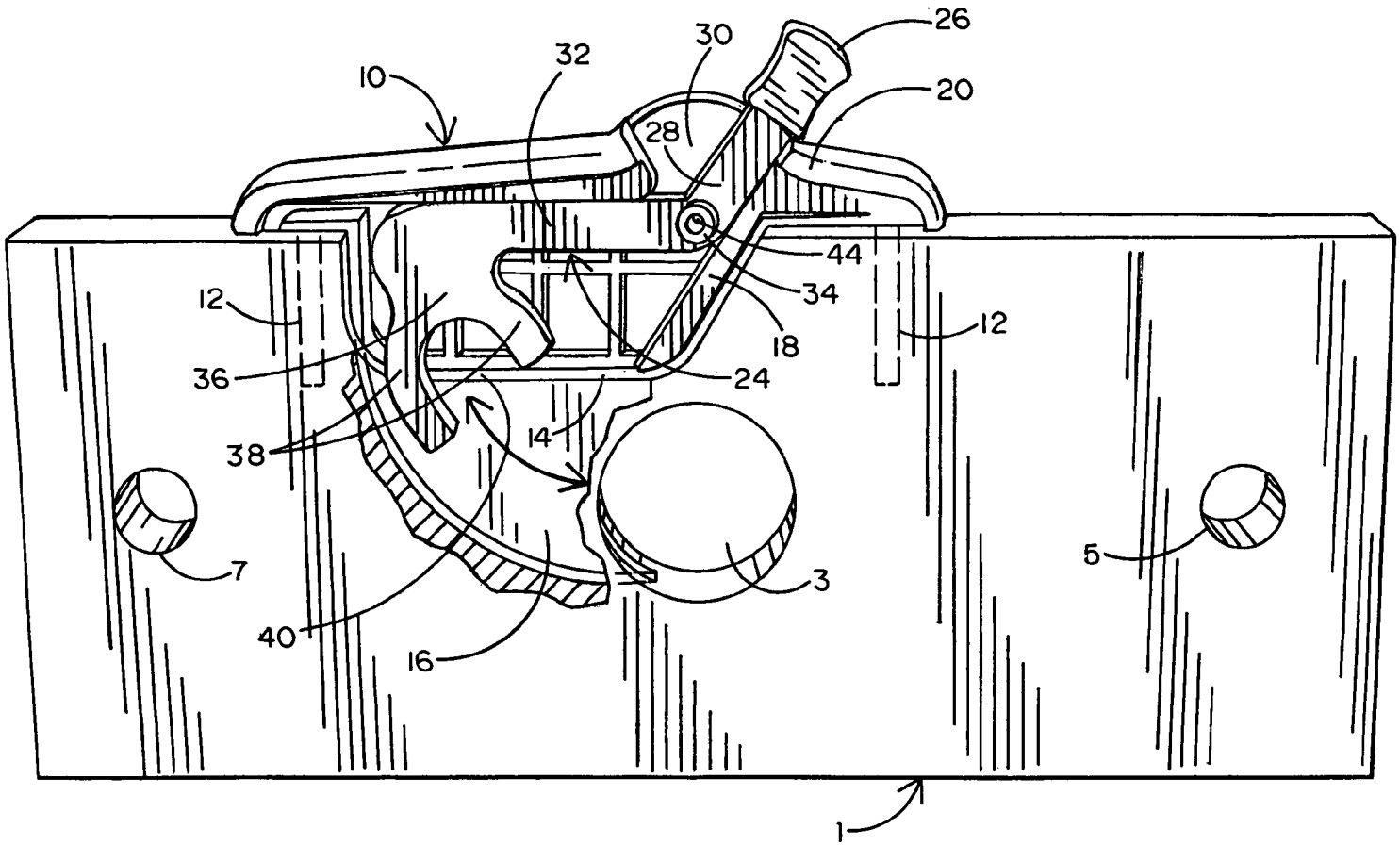
FIG. 3 is a top, partially broken-away view of the weight plate with the fork moved to the unlocked position.

In the case where the switch control knob 26 is rotated to the unlocked position of FIG. 3, the fork 36 is rotated around pivot pin 46 in an opposite direction through the intermediate channel 16 such that the pair of fingers 38 of fork 36 are pulled away from the center bore hole 3. Thus, the fork 36 is moved out of locking engagement with the center post of the weight lifting apparatus. The weight plate 1 is now uncoupled from the center post so as to no longer be part of the stack of weight plates to be lifted during the exercise in order to reduce the total weight of the lift. It may therefore be appreciated that the user will be able to selectively control the number of weight plates that are coupled to the center post and simultaneously lifted by moving the switch control knob 26 of each weight plate to one of the locked or unlocked positions in the manner just explained.

In this same regard, and as is best shown in FIG. 4, one end of a torsion (e.g., coil) spring 48 is connected to the toggle lever switch arm 24, and the opposite end of the spring 48 is connected to the housing 18 of the locking cartridge 10. The torsion spring 48 urges the switch arm 24 to automatically rotate towards either one of the unlocked or locked positions so as to avoid an indefinite, intermediate position therebetween.

Figure 5:
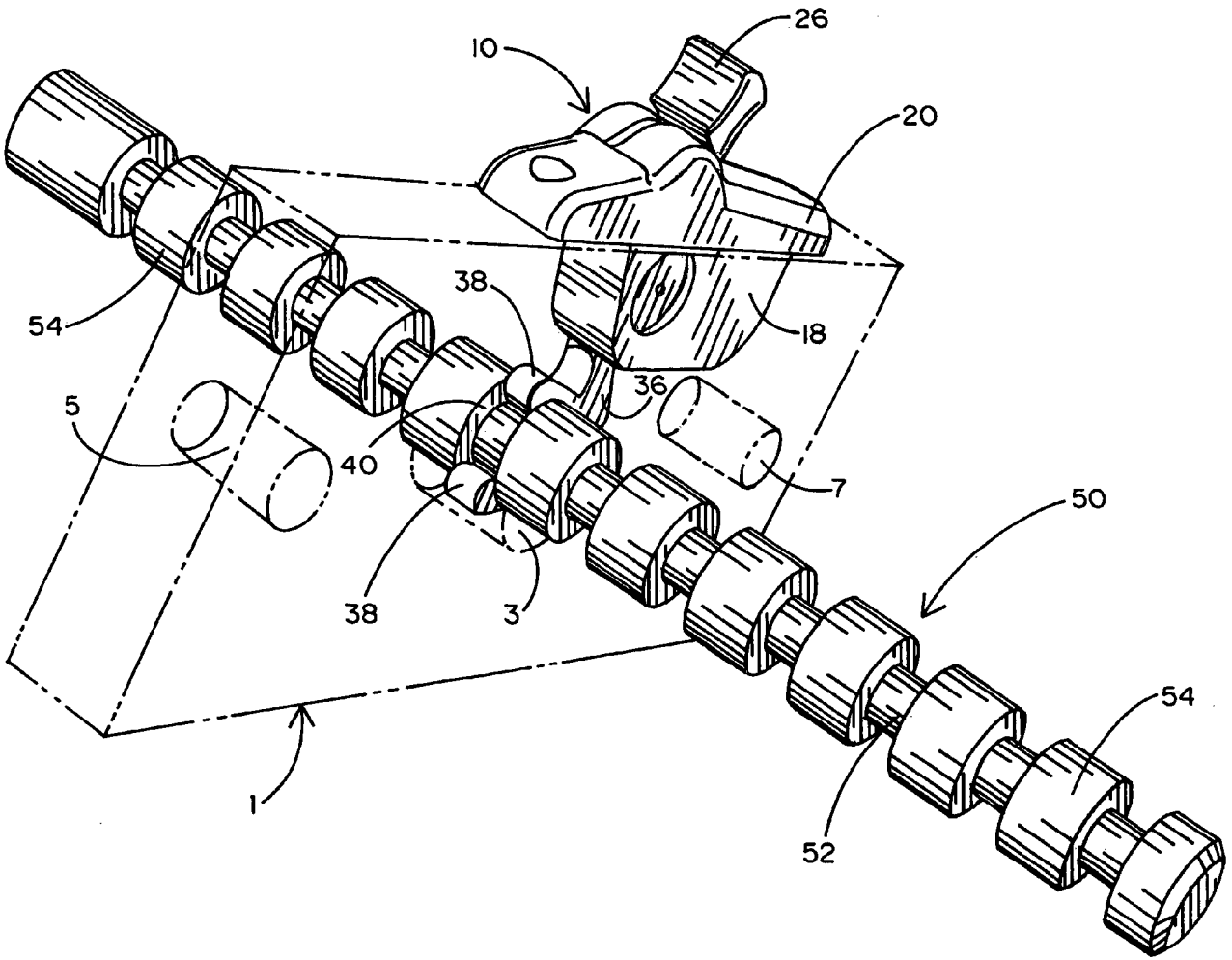
FIG. 5 shows the weight plate with the fork thereof moved to the locked position, whereby to couple the weight plate to a conventional center post of a weightlifting apparatus.

FIG. 5 of the drawings illustrates a known cylindrical center post 50 of the kind found in a weight plate lifting exercise apparatus. One or more weight plates, such as that designated 1 in FIGS. 1-4, can be selectively coupled to the center post 50 so as to be lifted by a user during a weight lifting exercise. As earlier explained, the center post 50 extends continuously through the center bore hole 3 of each weight plate from a stack of weight plates to be lifted.

The center post 50 includes an elongated cylindrical rod 52 that is surrounded by a plurality of cylindrical stops 54 that are uniformly spaced from one another. The diameter of the stops 54 is larger than the diameter of the rod 52 such that a gap is established between successive pairs of stops 54.

FIG. 5 shows the locking cartridge 10 after the switch control knob 26 thereof has been rotated to the locked position so that the weight plate 1 is releasably coupled to center post 50. More particularly, and as was previously described when referring to FIG. 4, moving the switch control knob 26 to the locked position causes the toggle lever switch arm (designated 24 in FIG. 4) to rotate within the housing 18 of locking cartridge 10 until the curved fork 36 carried by switch arm 24 is correspondingly rotated into the center bore hole 3 of weight plate 1 and into surrounding locking engagement with the center post 50.

In this case, the relatively narrow rod 52 of the center post 50 between a pair of adjacent relatively wide stops 54 is received within the round space 40 between the pair of fingers 38 of the fork 36. The fingers 38 surround and engage the rod 52 between the stops 54, whereby the center post 50 is captured by the fork 36. Accordingly, the weight plate 1 is now coupled to the center post 50 to be lifted with other plates of a stack of weight plates during the weight lifting exercise. In this same regard, any other weight plates may be selectively coupled to the center post 50 between pairs of adjacent stops 54 by simply rotating the switch control knobs 26 of respective locking cartridges 10 to the locked position like that shown in FIG. 5. As was previously described while referring to FIG. 3, one or more of the other weight plates from the stack can be uncoupled from the center post 50 by simply rotating the switch control knobs 26 to the unlocked position by which the respective forks 36 thereof are uncoupled from their surrounding locking engagement with center post 50.

Figure 6:
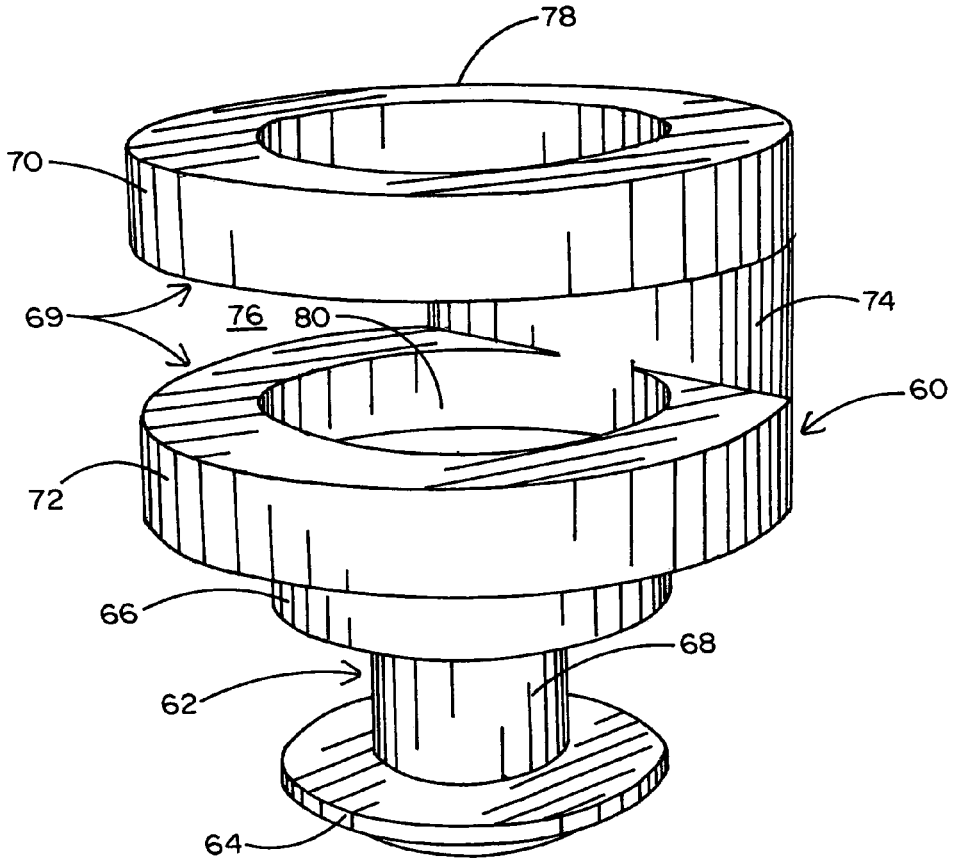
FIG. 6 shows a first insert to be mated to the weight plate of FIG. 9 at the center borre hole thereof in substitution of the center post shown in FIG. 5.

Turning now to FIG. 6 of the drawings, there is shown an insert 60. As will be explained when referring to FIG. 7, a series of inserts like that shown in FIG. 6 can be interconnected one to the other to create a center post as a substitute for the center post designated 50 and described while referring to FIG. 5. Each insert 60 is adapted to be wedged into the center bore hole and carried by a weight plate (designated 85 in FIG. 8) so that some or all of a plurality of weight plates can be coupled together in a stack to be lifted simultaneously during an exercise.

By virtue of being able to attach the weight plates together by means of a series of inserts 60, each weight plate 85 need not have the usual bore holes located at opposite sides of the center bore hole. In this same regard, the pair of vertical guide rods of the conventional weightlifting apparatus which commonly extend axially through the side bar holes of each weight plate may also be eliminated. In this case, a stack of weight plates can be lifted during an exercise along a curved path as opposed to a linear path which is necessitated by the constraints that are imposed by the pair of guide rods running vertically through the stack. Moreover, a relatively simple weight plate lifting exercise apparatus which requires less maintenance can be manufactured, inasmuch as the former pair of vertical guide rods are no longer required. Nevertheless, the weight plate 85 may still be manufactured with side bore holes 3 and 5 as shown to receive respective vertical guide rods therethrough.

The insert 60 includes a plug 62 located at a first end thereof. The plug 62 of insert 60 has an outwardly projecting locking head 64 which is spaced from a locking collar 66 by a cylindrical locking neck 68. Located at the opposite end of the insert 60 is a locking receptacle 69 that is formed by a pair of locking rings 70 and 72. The pair of locking rings 70 and 72 are held in spaced parallel alignment one above the other by a curved supporting wall 74 that runs therebetween. The supporting wall 74 surrounds an identical portion of each of the locking rings 70 and 72. A disk-like gap is established between the locking rings 70 and 72 in front of the supporting wall 74 to create an entrance opening 76 to the locking receptacle 69. The locking collar 66 of the plug 62 at the first end of the insert 60 is joined to the second 72 of the pair of spaced, parallel-aligned locking rings 70 and 72 at the opposite end of insert 60.

Each of the locking rings 70 and 72 of the locking receptacle 69 of the insert 60 has a round hole 78 and 80 formed therethrough. The holes 78 and 80 through locking rings 70 and 72 are axially aligned. The outside diameter of and distance between the pair of locking receptacles 70 and 72 of locking receptacle 69 are sized so that the rings will fit snugly within the center hole of the weight plate 85 which is to be coupled to one or more additional weight plates from a stack of plates (best shown in FIG. 8). Once the insert 60 is mated to the weight plate 85 as just described, the plug 62 of insert 60 which lies opposite the locking receptacle 69 will project outwardly from the weight plate to be interconnected to the insert that is mated to an adjacent weight plate from the stack.

Figure 7:
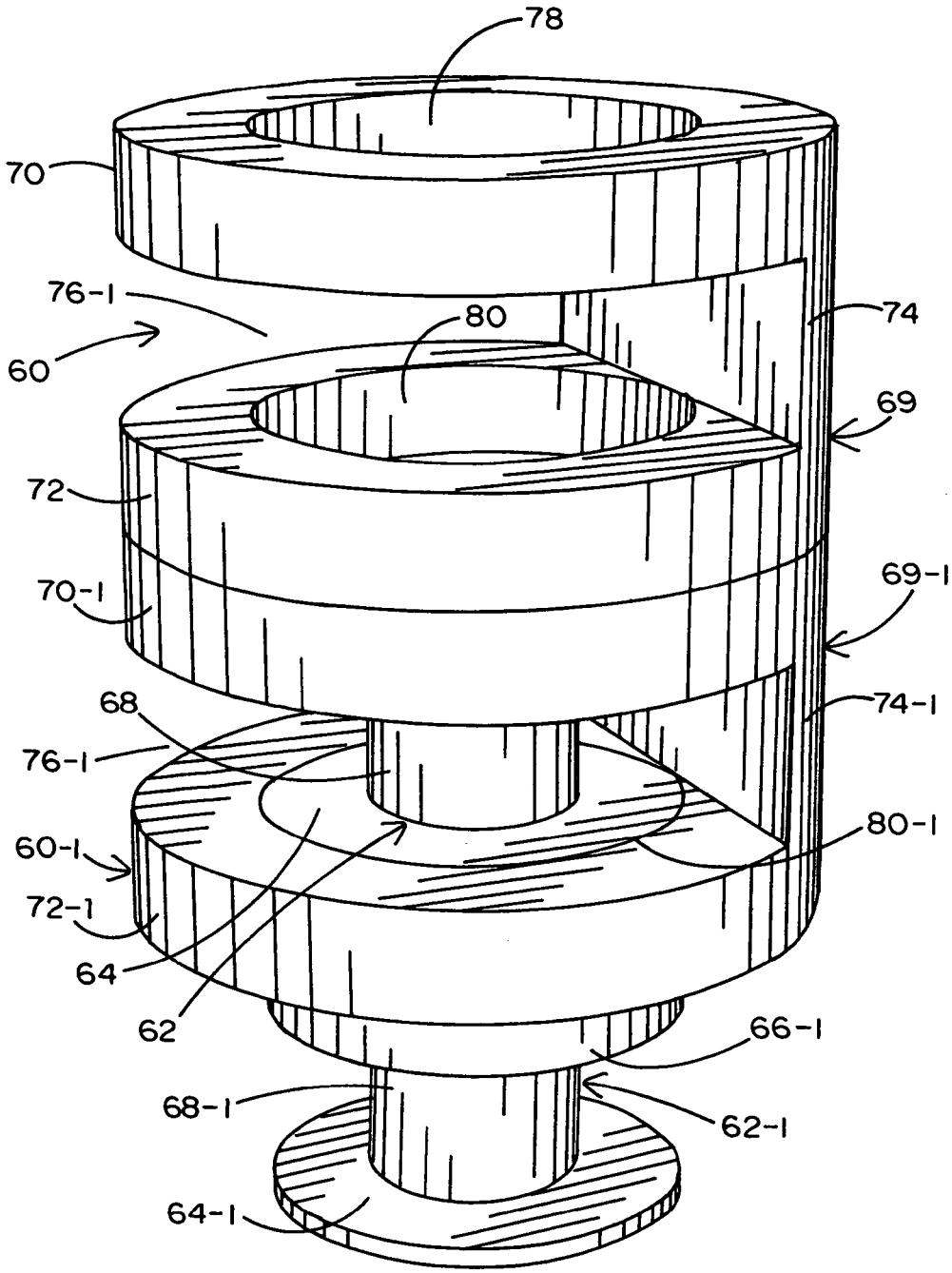
FIG. 7 shows the first insert of FIG. 6 connected to a second insert by which weight plates associated with the first and second inserts may be stacked and lifted together.

Turning now to FIG. 7 of the drawings, the insert 60 of FIG. 6 that is to be mated to one weight plate 85 of the stack is shown connected to an identical insert 60-1 that is to be mated to an adjacent weight plate from the stack as part of a piggyback system so that the corresponding weight plates will be connected to one another and lifted together during an exercise. Identical reference numerals have been used to designate identical features of the inserts 60 and 60-1. Therefore, the details of insert 60-1 will not be described again.

In the piggyback system shown in FIG. 7, an upper insert 60 to be mated to one weight plate is moved into detachable receipt by a lower insert 60-1 to be mated to a second weight plate. In this case, locking head 64 of the plug 62 of the upper insert 60 is pushed through the holes formed in the locking rings 70-1 and 72-1 of the locking receptacle 69-1 of the lower insert 60-1. In particular, the locking collar (designated 66 in FIG. 6) is received within the hole (not shown) through the first 70-1 of the pair of locking rings 70-1 and 72-1 of the lower insert 60-1. The locking head 64 of the upper insert 60 is wedged into receipt by the hole 80-1 in the second locking ring 72-1 of the lower insert 60-1. The locking rings 72 and 70-1 of the upper and lower inserts 60 and 60-1 are now secured end-to-end one another. The locking head 64-1 of the plug 62-1 of the lower insert 60-1 is accessible to be detachably received by an insert (not shown) to be associated with a third weight plate from the stack. In the assembled relationship, the curved supporting wall 74 extending between the pair of locking rings 70 and 72 and the entrance opening 76 between the locking rings will lie within the center bore hole of a corresponding weight plate (e.g., 85).

Figure 8:
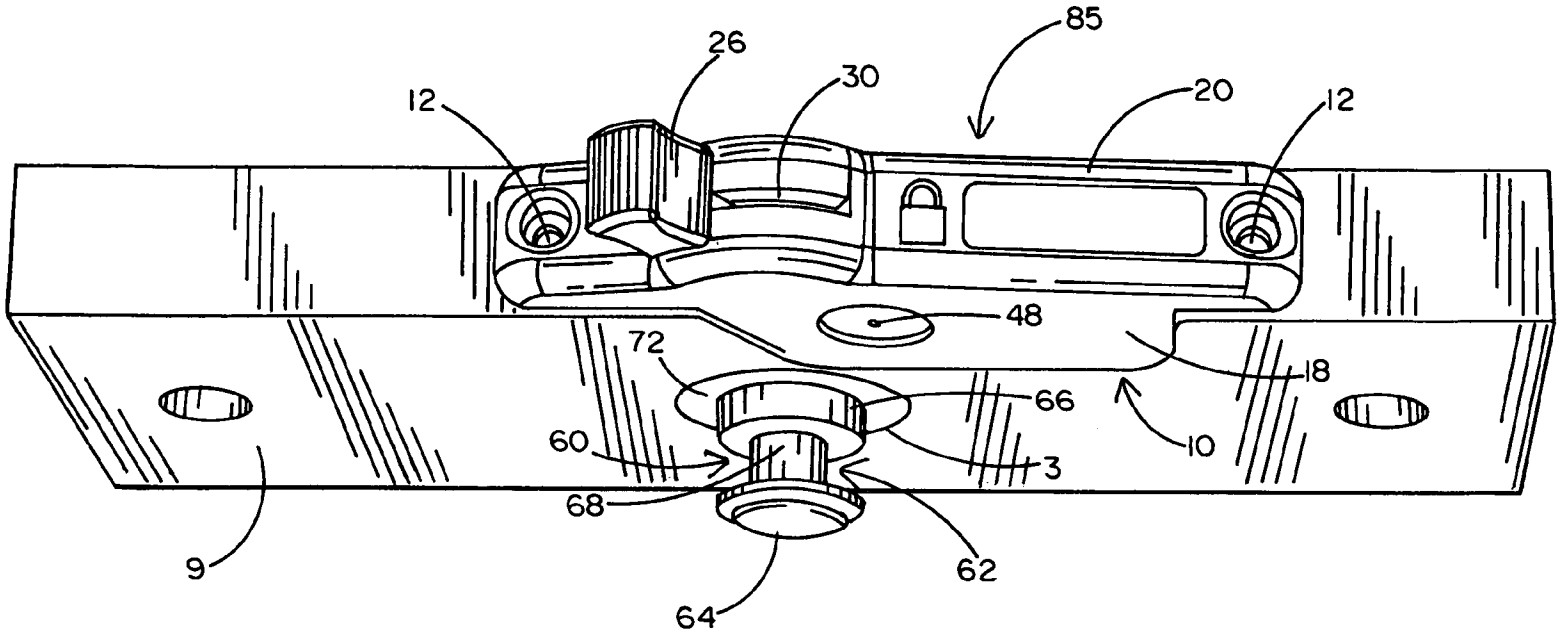
FIGS. 8 and 9 show a weight plate to which the insert shown in FIG. 6 is mated so that the weight plate can be coupled to and lifted with another weight plate.
Figure 9:
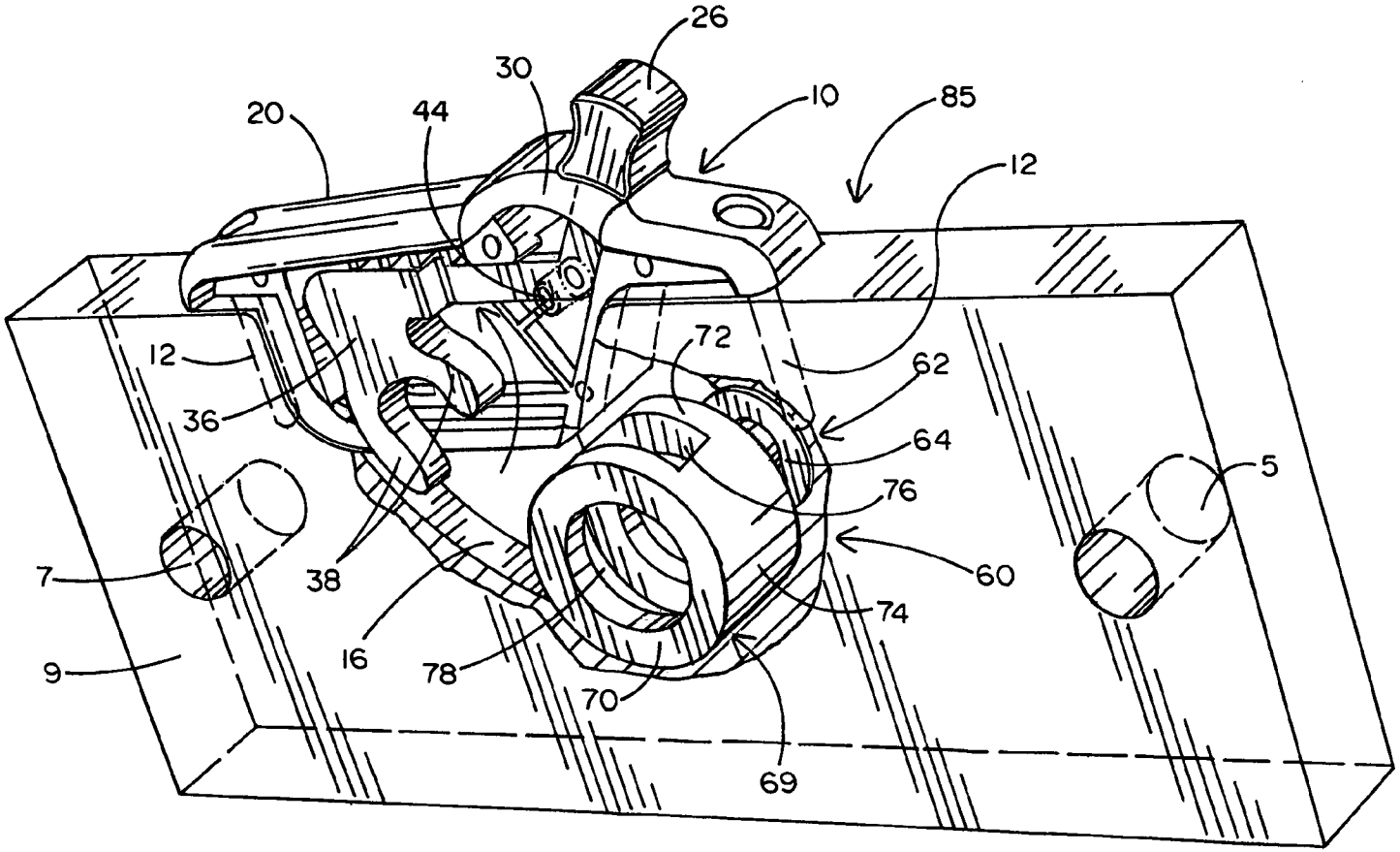

FIGS. 8 and 9 of the drawings show the weight plate 85 after the insert 60 of FIG. 6 has been mated thereto in the manner previously described. During the mating of insert 60 to weight plate 85, the locking rings 70 and 72 of the locking receptacle 69 of insert 60 are inserted into the center bore hole 3 of the weight plate body 9 (best shown in FIG. 9). Inasmuch as the weight plate 85 and the locking cartridge of FIGS. 8 and 9 may be identical to both the weight plate 1 and locking cartridge 10 of FIGS. 1-5, the same reference numerals have been used to designate the identical features of each.

Once the insert 60 is mated to the weight plate 85, the locking rings 70 and 72 of the locking receptacle 69 within the center bore hole 3 will lie flush with the front and back faces of the weight plate body 9. The plug 62 of the insert 60 will project outwardly from the plate body 9 so that the plug 62 of insert 60 can be wedged into receipt by the locking receptacle of a second insert (designated 60-1 in FIG. 7) associated with a second weight plate as was previously described, whereby the first and second weight plates will be held in face-to-face alignment with one another. To complete the foregoing arrangement, the locking neck 68 of the outwardly-projecting plug 62 of the insert 60 associated with the first weight plate 85 will be accessible within the center bore hole of the second weight plate in order to be surrounded and captured by the fork of the locking cartridge that is connected to the second weight plate.

Figure 10:
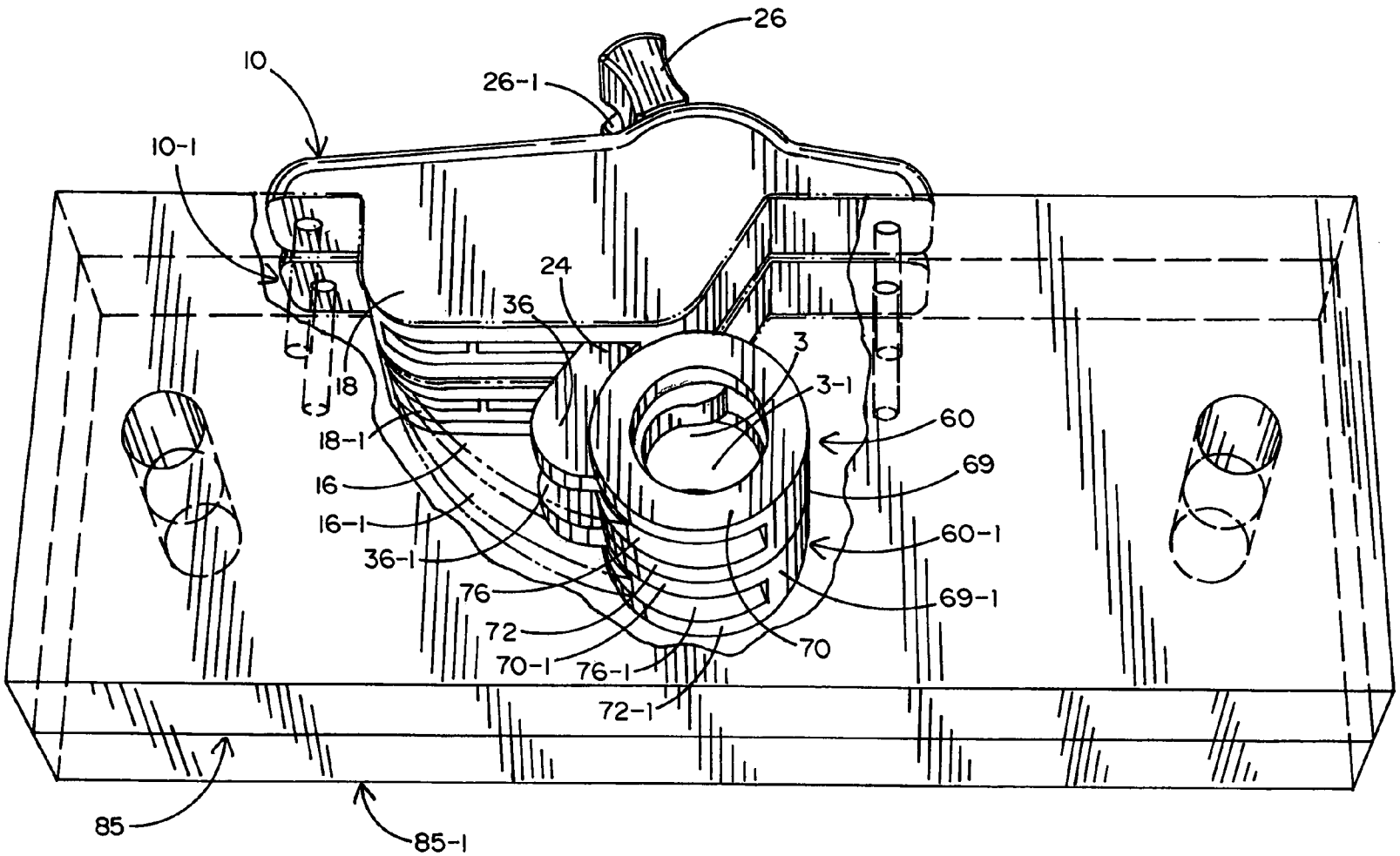
FIGS. 10 and 11 show first and second weight plates to which first and second inserts are attached so that the weight plates may be stacked and lifted together.
Figure 11:
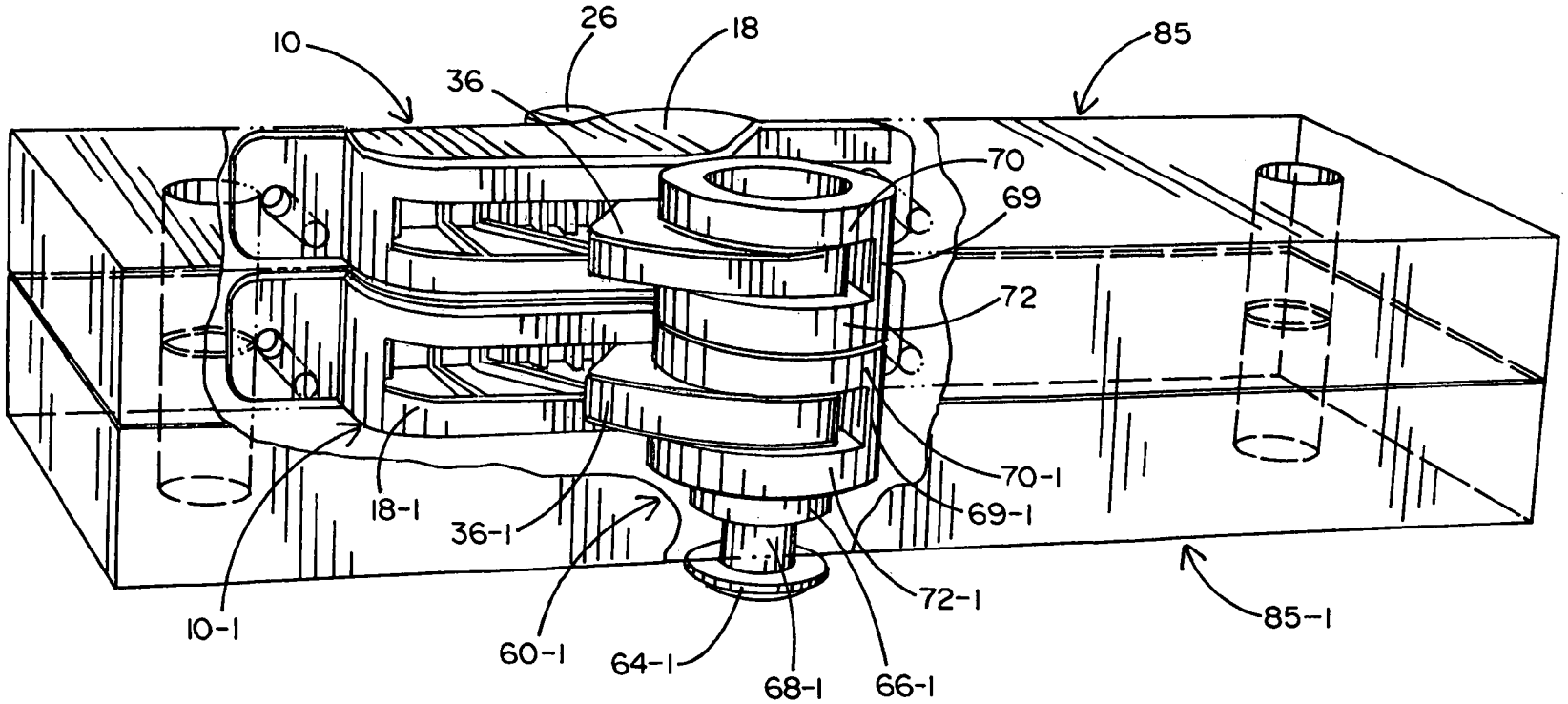

More particularly and turning to FIGS. 10 and 11 of the drawings, a pair of identical weight plates 85 and 85-1 are shown, each plate having an insert 60 and 60-1 wedged into the respective axially-aligned center bore holes thereof. That is, and as previously disclosed, the locking receptacles 69 and 69-1 of inserts 60 and 60-1 are received within the center bore holes 3 and 3-1 so that the locking head (designated 64 in FIG. 9) of the insert 60 which projects outwardly from the first weight plate 85 is pushed through the locking ring 70-1 and into mating engagement with the locking ring 72-1 of the locking receptacle 60-1 from the adjacent, second weight plate 85-1. The plug 62-1 of the insert 60-1 (best shown in FIG. 11) which projects outwardly from the second weight plate 85-1 is accessible to be mated to an insert associated with a third weight plate (not shown).

By way of example, in order to couple the second weight plate 85-1 to the plug 62 of the insert 60 which projects from the first weight plate 85 for receipt by the locking rings 70-1 and 72-1 of the insert 60-1 associated with the second weight plate 85-1, the switch control knob 26-1 of the toggle lever switch arm 24-1 is rotated to the locked position. Accordingly, the switch arm 24-1 is rotated inside the housing 18-1 of the locking cartridge 10-1 and through the intermediate channel 16-1 of weight plate 85-1 until the curved fork 36-1 that is carried by switch arm 24-1 is moved to the center bore hole 3-1 of weight plate 85-1. The curved fork 36-1 is thusly rotated through the entrance opening 76-1 in the locking receptacle 69-1 of insert 60-1 so as to be located in surrounding engagement with the locking neck 68 (of FIG. 7) from the plug 62 of the insert 60.

The second weight plate 85-1 is now coupled to the plug 62 of the insert 60 of the first weight plate 85 so that the second weight plate 85-1 can be lifted together with the first weight plate 85 during an exercise. When the toggle lever switch arm 24-1 is rotated in an opposite direction to the unlocked position, the fork 36-1 is once again moved through the entrance opening 76-1 in the locking receptacle 69-1 of insert 60-1 and out of its locking engagement with the insert 60, whereby the second weight plate 85-1 is now uncoupled from insert 60. The first weight plate 85 can be lifted without the second weight plate 85-1 in which case the plug 62 of insert 60 with projects from plate 82 will be pulled out of its receipt by the insert 60-1.

The first weight plate 1 (shown in FIGS. 1-6) and 85 (shown in FIGS. 8-11) from a stack of weight plates is coupled to a cable or belt (not shown) of the type commonly associated with weightlifting equipment. A pulling force applied by the user to the cable or belt causes the first weight plate and any other weight plates connected thereto to be lifted during a body building exercise.

The invention claimed is:

1. A combination comprising:

a weight plate having a bore hole formed therethrough; and a post received through the bore hole of said weight plate so that said weight plate can be coupled to and lifted by said post, said weight plate also having a pivotal switch arm that is rotatable relative to said weight plate, a first end of said pivotal switch arm receiving a force for causing said switch arm to rotate in either a first direction to an unlocked position at which the weight plate is uncoupled from the post or an opposite direction to a locked position at which the weight plate is coupled to the post so as to be lifted thereby, the opposite end of said pivotal switch arm being curved so as to lie in surrounding locking engagement with said post when said switch arm is in said locked position.

2. The combination recited in claim 1, wherein said weight plate has a hollow channel formed therewithin and communicating with said bore hole, said pivotal switch arm moving through said hollow channel to said bore hole so as to lie in said surrounding locking engagement with said post at said bore hole when said pivotal switch arm is rotated in the opposite direction to said locked position.

3. The combination recited in claim 2, said weight plate also having a hollow locking cartridge, said pivotal switch arm being rotatable within said locking cartridge and through the hollow channel formed in said weight plate for receipt at the bore hole through said weight plate at which to lie in said surrounding locking engagement with said post when said switch arm is rotated to the locked position.

4. The combination recited in claim 1, wherein said weight plate has a hollow interior, said pivotal switch arm extending from inside said hollow interior to the exterior of said weight plate and outside said hollow interior at which the first end of said pivotal switch arm receives the force for causing said switch arm to rotate in one of said first or opposite directions.

5. The combination recited in claim 1, wherein said weight plate also has a pivot connected to said pivotal switch arm, said switch arm rotating at said pivot between the locked and unlocked positions.

6. The combination recited in claim 5, wherein said pivot is connected to said pivotal switch arm between the first and opposite ends thereof.

7. The combination recited in claim 6, wherein the first and opposite ends of said pivotal switch arm are angled relative to one another, said pivot connected to said switch arm at the intersection of said first and opposite ends.

8. The combination recited in claim 1, wherein the curved opposite end of said pivotal switch arm is a fork having opposing first and second fingers and a round space lying between said first and second fingers, said post located within said round space at which to be engaged by said fingers when said switch arm is rotated to said locked position.

9. The combination recited in claim 8, wherein said post has a pair of stops extending therearound and being spaced from one another, the first and second fingers of said fork surrounding and engaging said post between said pair of stops when said post is located within the round space between said fingers.

10. The combination recited in claim 8, wherein the first and second fingers of said fork are located within the bore hole of said weight plate so as to surround and engage said post when said post is located within said round space between said fingers and said pivotal switch arm is rotated to the locked position.

11. A combination, comprising:

a first weight plate having a bore hole formed therethrough;

a second weight plate to be coupled to said first weight plate and having a bore hole formed therethrough;

a first insert and a second insert;

each of the first and second inserts having a hollow locking receptacle at one end thereof and a plug at the opposite end, the locking receptacle of said first insert being located in the bore hole of said first weight plate, the locking receptacle of said second insert being located in the bore hole of said second weight plate, and the plug of said first insert extending from said first weight plate for receipt within the locking receptacle of said second insert located in the bore hole of said second weight plate;

a first pivotal switch arm rotatable relative to said first weight plate between locked and unlocked positions, and a second pivotal switch arm rotatable relative to said second weight plate between locked and unlocked positions; and a first catch carried by and rotatable with said first pivotal switch arm, and a second catch carried by and rotatable with said second pivotal switch arm, said second pivotal switch arm receiving a force for causing said second pivotal switch arm to rotate in one of a first direction to said locked position at which said second catch is correspondingly rotated into locking engagement with the plug of said first insert received within the locking receptacle of said second insert, whereby said second weight plate is coupled to said first weight plate, or in an opposite direction to said unlocked position at which said second catch is rotated by said second pivotal switch arm out of said locking engagement with the plug of said first insert, whereby said second weight plate is uncoupled from said first weight plate.

12. The combination recited in claim 11, wherein said second weight plate has a hollow channel formed therewithin and communicating with the bore hole of said second weight plate, said second pivotal switch aim rotating through said hollow channel to said bore hole so that the second catch of said second pivotal switch arm lies in said locking engagement with the plug of said that insert at said bore hole when said second pivotal switch arm is rotated in the first direction to said looked position.

13. The combination recited in claim 12, said second weight plate also having a hollow locking cartridge, said second pivotal switch arm being rotatable within said locking cartridge and through the hollow channel formed in said second weight plate for receipt at the bore hole through said second weight plate at which the second catch of said second pivotal switch arm lies in said locking engagement with the plug of said first insert when said second switch arm is rotated to the locked position.

14. The combination recited in claim 13, wherein a first end of said second pivotal switch arm extends outside the hollow locking cartridge of said second weight plate at which to receive the force for causing said switch arm to rotate in one of said first or opposite directions, said second catch located at the opposite end of said second pivotal switch arm and lying within said hollow locking cartridge when said second switch arm is rotated to said unlocked position.

15. The combination recited in claim 14, wherein there is a pivot located within said hollow locking cartridge and connected to said second pivotal switch arm between said first end thereof and said second catch at the opposite end of said second pivotal switch arm, said second pivotal switch arm rotating at said pivot between said locked and unlocked positions.

16. The combination recited in claim 11, wherein the second catch carried by and rotatable with said second pivotal switch arm is curved so as to move into surrounding locking engagement with the plug of said first insert when said second pivotal switch arm is rotated to said locked position.

17. The combination recited in claim 16, wherein the curved second catch of said second pivotal switch arm that is rotatable relative to said second weight plate is a fork having opposing first and second fingers and a round space lying between said fingers, the ping of said first insert being located within said round space at which to be surroundingly and lockingly engaged by the fingers of said fork when said second pivotal switch arm is rotated to said locked position.

18. The combination recited in claim 11, wherein each of the hollow locking receptacles of each of said first and second inserts has an entrance opening formed therein, the second catch of said second pivotal switch arm that is rotatable relative to said second weight plate rotating into said locking engagement with the plug of said first insert received in the locking receptacle of the second insert by way of the entrance opening formed in the locking receptacle of said second insert when said second pivotal switch arm is rotated to said locked position.

19. A combination comprising:

a first weight plate having a bore hole formed therethrough and a channel formed therein that communicates with said bore hole;

a second weight plate having a bore hole formed therethrough and a channel formed therein that communicates with said bore hole;

coupling means running through the bore holes of said first and second weight plates to receive a lifting force by which said first and second weight plates are correspondingly lifted; and each of said first and second weight plates also having a respective pivotal switch arm including a first end at which to receive a pushing force and an opposite end at which a curved catch is located, the pivotal switch arm of each of said first and second weight plates rotating through said channel thereof to a locked position in response to a pushing force applied in a first direction to the first end of said pivotal switch arm by which the curved catch at the opposite end of said pivotal switch arm moves into surrounding engagement with said coupling means at said bore hole, and said pivotal switch arm rotating through said channel to an unlocked position in response to a pushing force applied in an opposite direction to the first end of said pivotal switch arm by which said curved catch at the opposite end of said pivotal switch arm is moved out of said surrounding engagement with said coupling means.

20. The combination recited in claim 19, wherein the curved catch at the opposite end of the pivotal switch arm of each of said first and second weight plates is a fork having opposing first and second fingers and a space lying between said fingers, said coupling means being located within said space when said curved catch is moved into said surrounding engagement with said coupling means.

* * * * *